United States Patent [19]

Duke

[11] Patent Number: 4,644,964

[45] Date of Patent: Feb. 24, 1987

[54] SMOKING ARTICLE MOUTHPIECE ELEMENTS

[75] Inventor: Martin G. Duke, Southampton, United Kingdom

[73] Assignee: British-American Tobacco Company Limited, London, England

[21] Appl. No.: 743,065

[22] Filed: Jun. 10, 1985

[30] Foreign Application Priority Data

Jun. 22, 1984 [GB] United Kingdom ..... 8415972

[51] Int. Cl.[4] ..... A24D 3/04

[52] U.S. Cl. ..... 131/336; 131/339

[58] Field of Search ..... 131/336, 340, 339, 198.1, 131/198.2

[56] References Cited

U.S. PATENT DOCUMENTS 3,343,319 8/1982 Cantrell ..... 131/336

3,678,941 7/1972 Dixon ..... 131/336

*Primary Examiner*—V. Millin

*Attorney, Agent, or Firm*—Kane, Dalsimer, Kane, Sullivan and Kurucz

[57] ABSTRACT

A smoking article mouthpiece comprises a smoke passage extending from end-to-end of the element and first and second ventilation ducts. The first ventilation ducts extend from the periphery of the element to the downstream end of the element at locations spaced inwardly from the periphery. The second ventilation ducts extend from the periphery to the upstream end of the element.

11 Claims, 7 Drawing Figures

SMOKING ARTICLE MOUTHPIECE ELEMENTS

Figure 1:
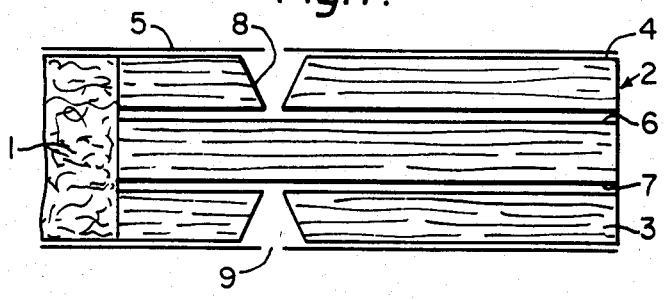

This invention relates to mouthpiece elements for smoking articles.

In German Patent Application document OLS No. 30 48 905.5 there is described a cigarette filter comprising a mouthpiece element in the form of a cylindrical body of filtration material which is provided with a plurality of periphical grooves each of which extends for the full length of the mouthpiece element. When the mouthpiece element is incorporated in a cigarette, the element is held in abutment with the tobacco rod thereof by means of a tipping wrapper which is provided with a ring or zone of ventilation perforations. A similarly constructed cigarette, embodying a similar mouthpiece element, is disclosed in European Patent Application Publication Document No. 61275. It is stated that the cigarette provides for the achievement of smoke delivery at a lower draw resistance than is usually found in prior art ventilated cigarettes.

Another document which discloses a similar mouthpiece element is United Kingdom Patent Application Document No. 2 098 051A.

It is an object of the present invention to provide mouthpiece elements which represent improvements upon the mouthpiece elements described in the above mentioned documents. It is a further object of the present invention to provide mouthpiece elements in the use of which in smoking articles the smoker registers an enhanced sensory perception of the smoke.

As used herein, the term "mouthpiece element" refers to an element incorporated, or intended for incorporation, in a smoking article at the mouth end thereof, or an element being, or forming part of, a smoking article holder. The mouthpiece element, or a portion thereof, may take the form of a filter.

The present invention provides a mouthpiece element comprising a smoke passage extending from end-to-end of said element and first and second ventilation ducts, said first duct extending from a location at the periphery of said element to a downstream end of said element at a location spaced from said periphery, and said second duct extending from a location at said periphery to an upstream end of said element.

Preferably, the peripheral location from which the first duct extends is the same as or near to the peripheral location from which the second duct extends.

Advantageously, the air flow impedance of the first ventilation duct is greater than the air flow impedance of the second ventilation duct. Suitably, the second ventilation duct is shorter than the first ventilation duct.

Conveniently, each or one of the first and second ventilation ducts comprises a tube formed of air impermeable material, although each or one of the first and second ventilation ducts may, as an alternative, comprise a bore formed in a matrix material, a foamed plastics material for example. As a further alternative, the second ventilation duct may comprise a cavity or groove formed in a matrix material. The first and second ventilation ducts may comprise portions of the same tube or bore. If this is not the case, preferably the air-flow controlling cross-section of the second duct is greater than the air-flow controlling cross-section of the first duct.

The first ventilation duct may with advantage be one of a plurality of substantially identical ducts. Similarly, the second ventilation duct may with advantage be one of a plurality of ducts substantially identical to the second ventilation duct.

The smoke passage may take the form of a matrix material of fibrous or open-cell foamed form. If a closed cell or otherwise inherently smoke impermeable matrix material surrounds the first and/or the second ventilation ducts, the smoke passage may be provided in the form of a further tube(s) or bore(s) extending through the matrix material.

In order that the present invention may be clearly understood and readily carried into effect, reference will now be made, by way of example, to the accompanying diagrammatic drawings, in which:

FIG. 1 shows, in axial section, parts of a cigarette comprising a mouthpiece element; and FIGS. 2 to 7 show, each in axial section, mouthpiece elements different from that of FIG. 1, but each of which is capable of being incorporated in a cigarette in a manner similar to that of the mouthpiece element of FIG. 1.

The cigarette of which parts are shown in FIG. 1 comprises a paper wrapped tobacco rod 1 and a mouthpiece element generally designated 2, comprising a cylindrical plug 3 of cellulose acetate fibres, providing a matrix material, wrapped in a paper plugwrap 4. The tobacco rod 1 and the mouthpiece element 2 are interattached by a tipping wrapper 5.

Extending within the mouthpiece element 2, from the upstream end, i.e. that in abutment with the tobacco rod 1, to the downstream end, are two plastics tubes 6 and 7. As may be seen from FIG. 1, the tubes 6 and 7 are parallel to each other and are located intermediate the axis and the periphery of the element 2, at opposite sides of the axis.

The mouthpiece element 2 also comprises an annular groove 8 which is located nearer to the upstream than the downstream end of the element 2. As may be seen from FIG. 1, the groove 8 is of such depth that it opens into each of the tubes 6 and 7. The side faces of the groove 8 are smke impervious. A convenient method of forming the groove 8 is thermal moulding. This has the advantage that the side faces of the groove 8 are thermally sealed so as to render them gas impervious. An apparatus of a type which may be employed to thermally mould the groove 8 is described in United Kingdom Patent Specification No. 1,507,765.

The groove 8 and the portions of the tubes 6, 7 which extend therefrom to the downstream end of the mouthpiece element 2 provide first ventilation ducts, whereas the groove 8 and the portions of the tubes 6, 7 which extend from the groove 8 to the upstream end of the element 2 provide second ventilation ducts. In that the second cuts are significantly shorter than the first ducts, the second ducts present a lower air flow impedance than do the first ducts.

The tipping 5 is provided with a ring of ventilation perforations 9 at a location of the tipping 5 which overlies the groove 8. Thus when the cigarette of FIG. 1 is smoked, ventilation air is drawn into the annular groove 8 through the perforations 9. From the groove 8 a proportion of the ventilating air flows directly to the downstream end of the element 2 through the portions of the tubes 6, 7 which extend thereto. The remainder of the ventilation air flows to the tobacco rod 1, through the portions of the tubes 6, 7 which extend to the upstream end of the element 2, and intermingles with smoke which is drawn through the cellulose acetate fibres of the plug 3. As the air-diluted smoke issues from the downstream end of the element 2 the smoke encounters further ventilating air issuing as jets from the downstream, outlet ends of the tubes 6, 7, which outlet ends are located inwardly of the periphery of the element 2. There is thereby produced a smoke pattern which enhances the smoker's sensory perception of the smoke.

The respective mouthpiece elements of FIGS. 2 to 7, although differing in construction from the element of FIG. 1, operate in a similar manner to the element of FIG. 1 when incorporated in a cigarette. That is to say, in each case a first proportion of air issues in jet fashion from the downstream end of the element, at locations inward of the periphery of the element, while a second proportion of ventilating air passes into contact with, and dilutes, the tobacco smoke before the smoke issues from the element. Thus no further mention will be made of the operation of the mouthpiece elements of FIGS. 2 to 7.

Figure 2:
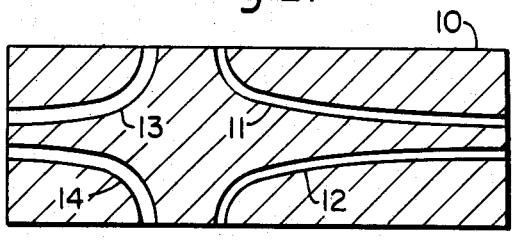

The mouthpiece element of FIG. 2 is of plastics construction and comprises a tubular body 10 within the interior of which extend first ventilation tubes 11 and 12 and second ventilation tubes 13 and 14. Each of the tubes 11–14 is formed integrally with the body 10. As may be seen from FIG. 2, the tubes 11, 12 extend from diametrically opposed peripheral locations of the body 10, nearer to the upstream end than the downstream end of the element 2, to locations at, and close to the centre of, the downstream end of the element. The tubes 13, 14 extend from respective peripheral locations, close to but upstream of the upstream, inlet ends of the tubes 11, 12, to locations at, and close to the centre of, the upstream end of the element 2. The tubes 13, 14 are shorter than the tubes 11, 12, but are of a larger cross-section. For both of these reasons, the air-flow impedance of the tubes 13, 14 is less than that of the tubes 11, 12.

The mouthpiece element of FIG. 2 may be incorporated in a cigarette using a tipping wrapper (not shown) which is provided with a first ring of ventilation perforations overlying the inlet ends of the tubes 11, 12 and a second ring of ventilation perforations overlying the inlet ends of the tubes 13, 14.

Figure 3:
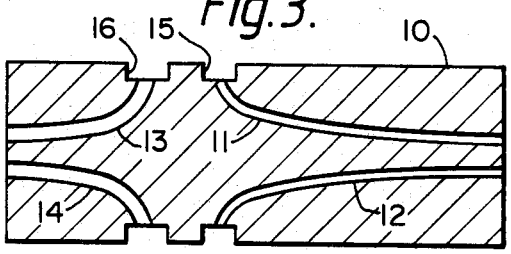

The mouthpiece element shown in FIG. 3 is closely similar to that of FIG. 2 and thus corresponding parts have been given the same reference numerals. The inlet ends of tubes 11, 12 of the element of FIG. 3, rather than opening directly at the periphery of the tubular body 10, open at an annular groove 15 formed in the body 10. The inlet ends of the tubes 13, 14 similarly open at an annular groove 16 formed in the body 10. In incorporating the FIG. 3 mouthpiece element in a cigarette, use may be made of tipping provided with two rings of ventilation perforations overlying respectively the grooves 15 and 16.

Figure 4:
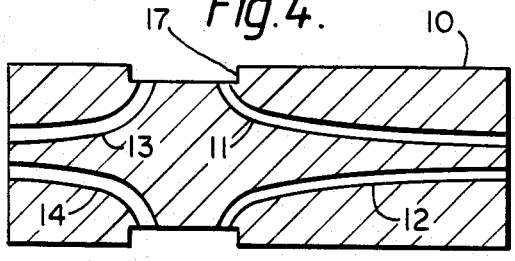

Again, the mouthpiece element of FIG. 4 is closely similar to that of FIG. 2 and the same reference numerals have been used for corresponding parts. The tubes 11, 12 and the tubes 13, 14 of the FIG. 4 element all have the inlet ends thereof open at a single annular groove 17 formed in the tubular body 10 of the element.

Figure 5:
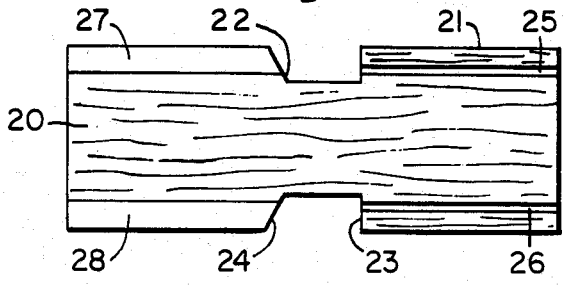

The mouthpiece element shown in FIG. 5 comprises a filter plug 20 of fibrous cellulose acetate and a plugwrap 21. An annular groove 22 which is formed in the plug 20 comprises a downstream face 23 which is perpendicular to the longitudinal axis of the plug 20 and an upstream face 24 which diverges, in a radially outward direction, from the face 23. First ventilation ducts comprise plastics tubes 25 and 26 which extend, parallel to the longitudinal axis of the plug 20, from the downstream face 23 of the groove 22 to the downstream end of the element. Second ventilation ducts comprise peripheral grooves 27 and 28 which extend from the upstream face 24 of the annular groove 22 to the upstream end of the element.

Conveniently, the annular groove 22 and the peripheral grooves 27, 28 are formed by thermal moulding. As shown in the axial section of the mouthpiece element depicted in FIG. 5, the groove 27 is aligned with the tube 25 and likewise, the groove 28 is aligned with the tube 26. Thus the portions of the tubes 25, 26 which initially extended leftward of the face 24 of the groove 22 are removed during the thermal moulding of the grooves 27, 28. However, it would be difficult in practice to arrange that the grooves 27, 28 were so angularly disposed of the element that they coincided with the position of the tubes 25, 26. It is for this reason that the face 24 of the groove 22 is arranged to be sloping, since during the thermal moulding of the groove 22, the sloping face with which the heated moulding former is provided in order to shape the face 24, also acts, should the grooves 27, 28 not be aligned with the tubes 25, 26, to seal by thermal welding the downstream ends of the portions of the tubes 25, 26 which extend leftwardly of the groove 22. Because the face of the former which shapes the face 23 of the groove 22 is perpendicular to the longitudinal axis of the element, the upstream ends of the tubes 25,26 opening at the face 23 are not sealed in the thermal moulding process. The thermal moulding process used to form the grooves 22, 27 and 28 serves to provide these grooves with air impermeable walls.

It may be noted that the grooves 27, 28 are shorter than the tubes 25, 26 and are of a larger air-flow cross-section.

The mouthpiece element of FIG. 5 may be incorporated in a cigarette using a tipping wrapper provided with a ring of ventilation perforations overlying the annular groove 22.

Figure 6:
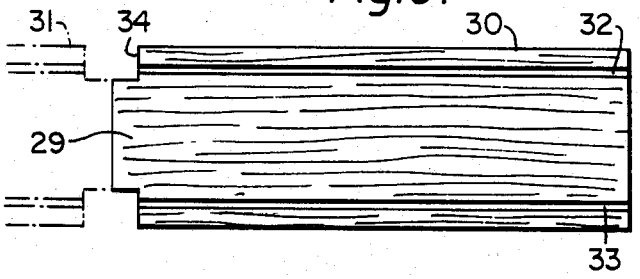

The mouthpiece element of FIG. 6 comprises a filter plug 29 of fibrous cellulose acetate and a plugwrap 30. This mouthpiece element initially formed a section of a filter rod of a length a multiple of a unit element length. Parts of an initially adjacent length of the rod are indicated in phantom at 31. Extending throughout the length of the initially existing filter rod were two parallel plastics tubes 32 and 33. The rod was subjected to a thermal moulding process to produce an annular groove which bisected, but did not seal, the tubes 32, 33. The unit lengths of the rod were then severed at a central transverse plan of the annular groove thus to provide an element having an upstream end conformation as shown in full line in FIG. 6.

When the mouthpiece element of FIG. 6 is incorporated in a cigarette, the upstream end of the element abuts the tobacco rod of the cigarette. There is thus defined an annular ventilation groove at a downstream face 34 of which open the upstream, inlet ends of the tubes 32, 33. The annular ventilation groove and the tubes 32, 33 form first ventilation ducts, whereas the annular ventilation groove alone forms a second ventilation duct directly in communication with the tobacco rod. A tipping wrapper provided with perforations overlying the annular groove may be employed.

Figure 7:
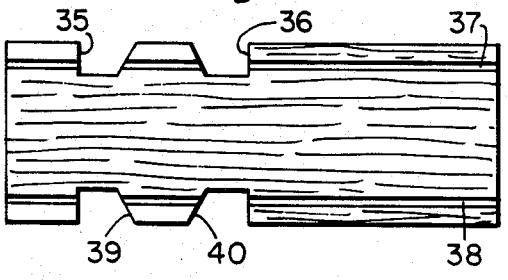

The mouthpiece element of FIG. 7 is formed of filter rod which is initially the same as that used for making elements as per FIG. 6. However, whereas the latter elements are each provided with a half annular groove at the upstream end, the element of FIG. 7 is provided with two full annular grooves 35 and 36. The downstream groove 36 is closer to the upstream than the downstream end of the element and both of the grooves 35, 36 bisects each of two plastics tubes 37 and 38 which extend through the element. Each of the grooves 35, 36 is formed by thermal moulding and, as can be seen from FIG. 7, downstream face 39 of groove 35 and upstream face 40 of groove 36 are formed by sloping sides of the moulding former. Thus both ends of the short portions of tubes 37, 38 which extend between grooves 35, 36 are thermally sealed.

In incorporating the mouthpiece element of FIG. 7 in a cigarette, use may be made of a tipping wrapper which is provided with a first ring of perforations overlying the groove 35 and a second ring of ventilation perforations overlying the groove 36.

Although in the above descriptions with reference to FIGS. 1, 5, 6 and 7 mention has been made of fibrous cellulose acetate as a matrix material, it will be readily appreciated by those skilled in the art that alternative materials, fibrous polypropylene for example, could be employed. It will also be readily understood that the form of the matrix material may be other than fibrous. Thus, for example, a matrix material may be provided which is in the form of an open or closed cell rigid foam. If the matrix takes the form of a rigid foam, bores extending therethrough may be provided instead of tubes. If a closed cell foam is employed, it will be necessary to provide a further bore(s), or a tube(s), for the passage of tobacco smoke through the filter element. It will further be appreciated with regard to FIGS. 2, 3 and 4 that there could be disposed within the body 10 a fibrous or other form of matrix material.

What is claimed is:

1. A mouthpiece element comprising a smoke passage extending from end-to-end of said element and first and second ventilation ducts, said first duct extending from a location at the periphery of said element to a downstream end of said element at a location spaced from said periphery, and said second duct extending from a location at said periphery to an upstream end of said element and wherein the air flow impedance of said first duct is greater than the air flow impedance of said second duct.

2. A mouthpiece element as claimed in claim 1, wherein at least one of said first duct and said second duct comprises a tube.

3. A mouthpiece element as claimed in claim 1, wherein at least one of said first duct and said second duct comprises a bore formed in a matrix material.

4. A mouthpiece element as claimed in claim 1, wherein the length of said first duct is greater than the length of said second duct.

5. A mouthpiece element as claimed in claim 1, wherein one of said first duct and said second duct is a groove at the periphery of said element, said groove extending lengthwise of said element.

6. A mouthpiece element as claimed in claim 1, wherein said second duct takes the form of a cavity in a matrix material.

7. A mouthpiece element as claimed in claim 1, wherein said first duct is one of a plurality of commonly configured first ducts.

8. A mouthpiece element as claimed in claim 1, wherein said second duct is one of a plurality of commonly configured second ducts.

9. A mouthpiece element as claimed in claim 1, wherein said smoke passage takes the form of a body of matrix material.

10. A mouthpiece element as claimed in claim 1, wherein said smoke passage takes the form of a duct extending within a matrix material.

11. A smoking article comprising a smoking material rod having a first and second end; a mouthpiece element according to attached to an end of the rod, said mouthpiece element comprising a smoke passage extending from end-to-end of said element and first and second ventilation ducts, said first duct extending from a location at the periphery of said element to a downstream end of said element at a location spaced from said periphery, and said second duct extending from a location at said periphery to an upstream end of said element and wherein the air flow impedance of said first duct is greater than the air flow impedance of said second duct; and wrapping means wrapped about the periphery of said element, said wrapping means permitting the ingress of ventilation air into said first duct and said second duct of said element.

* * * * *